US006583536B1

(12) United States Patent
Gibboney, Jr.

(10) Patent No.: US 6,583,536 B1
(45) Date of Patent: Jun. 24, 2003

(54) MULTIPLE, SEQUENTIAL FILAMENT LAMP

(76) Inventor: James W Gibboney, Jr., 3910 Dial Mill Rd., Conyers, GA (US) 30208

( * ) Notice: Subject to any disclaimer, the term of this patent is extended or adjusted under 35 U.S.C. 154(b) by 0 days.

(21) Appl. No.: 09/504,215

(22) Filed: Feb. 15, 2000

(51) Int. Cl.[7] ..... H01K 1/70; H01J 7/44; H01J 17/34

(52) U.S. Cl. ..... 313/115; 313/112; 313/331; 313/332; 315/47; 315/64; 315/65

(58) Field of Search ..... 313/115, 112, 313/331, 333; 315/65, 47, 64, 68, 67

(56) References Cited

U.S. PATENT DOCUMENTS

| | | | | | |
|---|---|---|---|---|---|
| 2,605,446 | A | * | 7/1952 | Cartun | 315/120 |
| 3,673,534 | A | * | 6/1972 | Marinace | 337/258 |
| 3,794,880 | A | * | 2/1974 | Peretti et al. | 315/125 |
| 4,233,543 | A | * | 11/1980 | Hickok | 313/315 |
| 4,340,841 | A | * | 7/1982 | Schupp | 313/315 |
| 4,382,209 | A | * | 5/1983 | Loucaides | 315/362 |
| 4,808,885 | A | * | 2/1989 | Bauch et al. | 315/122 |
| 4,841,196 | A | * | 6/1989 | Waymouth | 313/316 |
| 5,061,879 | A | * | 10/1991 | Munoz et al. | 315/129 |
| 5,722,760 | A | | 3/1998 | Chien | |
| 5,749,646 | A | | 5/1998 | Brittell | |
| 5,800,047 | A | | 9/1998 | Yang | |
| 5,865,533 | A | | 2/1999 | Liu | |
| 5,886,423 | A | | 3/1999 | Gershen et al. | |
| 5,886,458 | A | | 3/1999 | Chen Hsu | |
| 6,127,772 | A | * | 10/2000 | Carlson | 313/112 |

FOREIGN PATENT DOCUMENTS

| | | | | |
|---|---|---|---|---|
| DE | 2417075 B | * | 6/1975 | B61L/9/04 |

* cited by examiner

*Primary Examiner*—Ashok Patel
*Assistant Examiner*—Sikha Roy
(74) *Attorney, Agent, or Firm*—Michael A. Mann; William Y. Klett; Nexsen Pruet Jacobs & Pollard, LLC

(57) ABSTRACT

An improvement to the current-carrying components of a lamp includes two filaments connected to two different electrodes and one common electrode, and a switch for directing current through the secondary filament upon the failure of the primary filament. Normally, the current flows through the primary filament. The switch in one embodiment is a wire that does not conduct when the primary filament is operational but conducts on the failure of the primary filament to shunt the current to the secondary filament. The wire is an oxide metal wrapped around two of the three electrodes inside the glass envelop of the lamp. When the primary filament fails, the open circuit voltage breaks across the oxide layer to weld the wire to the electrodes and bypass the primary filament.

10 Claims, 3 Drawing Sheets

MULTIPLE, SEQUENTIAL FILAMENT LAMP

FIELD OF THE INVENTION

The present invention relates to lamps. More particularly, the present invention relates to multi-filament lamps.

BACKGROUND OF THE INVENTION

Inside the glass envelope or bulb of an incandescent lamp, there is a filament extending between two terminals. When a voltage is applied across the terminals, the resistance of electric current running through the filament causes the filament to heat to the point where it will glow.

Eventually, the operation of the lamp including thermal expansion and contraction of the filament when the light is turned on and off, will cause the filament to fail or "burn-out". When a lamp burns out, it must be replaced. The burned-out lamps are not repaired.

Some bulbs contain more than one filament. These bulbs will give off different light intensities depending on how many of the filaments are conducting current. Nonetheless, when all of the filament fails, the bulb will not light.

Light bulbs will last for several hundred hours before burning out. Some light bulbs will last much longer and are referred to as "long life" bulbs. Long life bulbs are made with heavier gauge filaments. However, when the filament fails, the bulb must be replaced.

Thus, there remains a need for a way to extend the life of a light bulb.

SUMMARY OF THE INVENTION

According to its major aspects and briefly recited, the present invention is the bulb having at least two filaments wherein, when the first filament burns out, current will be conducted across the electrodes in the bulb by the next filament. To turn on the second filament, a shunt, made of a fine wire, is closed to connect the second filament between the secondary filament electrode of the circuit and the common electrode, thus relighting the lamp. The open circuit voltage welds the shunt to the primary and secondary electrodes.

Each additional filament has its own electrode and shunt that will link its electrode back to the primary filament electrode. Each shunt will have a different resistance. When the primary filament burns out, an arbitration takes place among the remaining filaments in order of resistance of their shunts. The one with the first conductance welds its shunt closed.

In addition, when a bulb according to the present preferred invention is used with other bulbs in a series circuit, such as with Christmas light strings, an additional, bypass shunt can be placed in each bulb between the second filament electrode and the common electrode. After the secondary filament burns out, this shunt will weld itself across the electrodes and conduct so that the light string remains on notwithstanding the fact that a bulb has burned out.

A feature of the present invention is the use of at least one backup filament. When the first filament burns out, the light will operate using the second filament. Not only does the second filament extend the useful life of the light by about a factor of two, but also it reduces the time and cost of changing light bulbs by the same factor. Even allowing for somewhat higher manufacturing cost of the present dual, sequential lamp, the overall cost savings of the present lamp compared to prior art lamps is significant.

Another feature of the present invention is a switch inside the bulb that operates when the first filament burns out. Therefore, the present bulb can be used in current light sockets without modification to the lamp socket because there is no change in the exterior configuration of the bulb.

Still another feature of the present invention is the use of the open circuit voltage and a shunt to switch the current to the second filament. This feature enables the second filament to operate sequentially and automatically on the failure of the first filament.

In an alternative embodiment, as part of a plurality of lights in a series circuit, use of a bypass shunt to pass current when all of the filaments are burned out is an important feature of this embodiment of the present invention.

Other features and their advantages will be apparent to those skilled in the art of lamp design from a careful reading of a Detailed Description Of Preferred Embodiment accompanied by the following drawings.

DETAILED DESCRIPTION OF PREFERRED EMBODIMENTS

The present invention is an improvement to the current-carrying components of a lamp. In particular, the improvement includes at least one additional filament and a switch for each additional filament for directing current through one of the additional filaments upon the failure of the first filament. This improvement extends the operating life of the lamp by approximately 100% for each additional filament. Furthermore, because the only change to the lamp is in the interior components, the present improved lamp can be inserted in any existing lamp socket.

Figure 1:
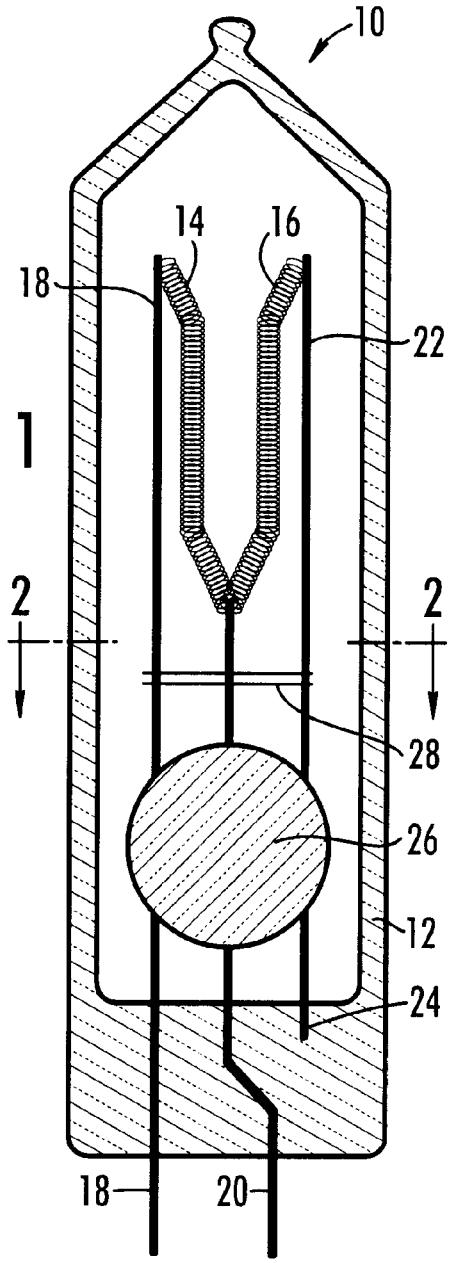
FIG. 1 is a cross-sectional view of a lamp according to a preferred embodiment of the present invention.
Figure 2:
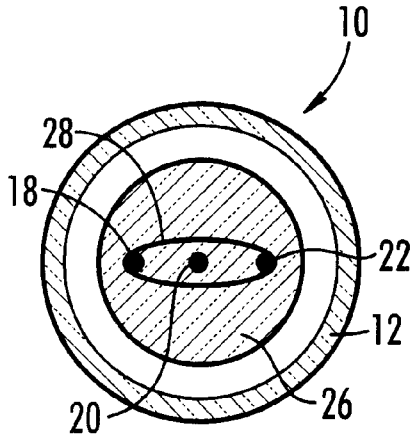
FIG. 2 is a cross-sectional view of the lamp of FIG. 1 taken along lines 2—2.

FIGS. 1 and 2 illustrate the present invention with one additional filament. The improved lamp, generally indicated by reference number 10, includes a sealed glass or plastic envelope 12. In the interior of envelope 12 are two filaments. A filament 14 acts as a primary filament; a filament 16 acts as a secondary filament. Primary filament 14 is connected at one end to a primary electrode 18 and at another end to a common electrode 20. Electrodes 18 and 20 extend through the wall of envelope 12 where they may be connected to a source of electrical potential. Secondary filament 16 is connected at a first end to common electrode 20 and at a second end to a secondary electrode 22. Secondary electrode 22 does not extend through the wall of envelope 12 but is anchored in it at location 24. An insulator 26 helps to secure the inter-terminal spacing of electrodes 18, 20 and 22 to prevent them from touching. Electrodes 18, 20, and 22 are electrical conductors. Primary and secondary filaments 14, 16, are also electrical conductors. Thus, primary electrode 18, primary filament 14 and common electrode 20 form part of an electrical circuit, and common electrode 20, secondary filament 16 and secondary electrode 22 form part of an electrical circuit.

A wire 28 is wrapped around electrodes 18 and 22. Preferably wire 28 is made of aluminum oxide or some other oxidizable metal and acts as a shunt. Normally the oxide coating on wire 28 will not conduct electricity, so electrical current flows from primary electrode 18 to common electrode 20. When the primary filament 14 burns out, the open circuit voltage breaks across the oxide coating, welds wire 28 closed, shorting the secondary filament 16 into the circuit and by-passing primary filament 14. Once secondary filament 16 is in the circuit, the lamp re-lights. To break across the oxide coating, the voltage must be above 35 volts for aluminum oxide.

It will be clear from the foregoing that wire 28 acts as a switch turning on secondary filament 16 in response to the failure of primary filament 14. Furthermore, while primary filament 14 is operational, secondary filament 16 collects vaporized tungsten molecules given off by primary filament 14. These molecules would otherwise condense on the inside of envelope 12. These molecules are then available to extend the life of secondary filament 16.

Figure 3:
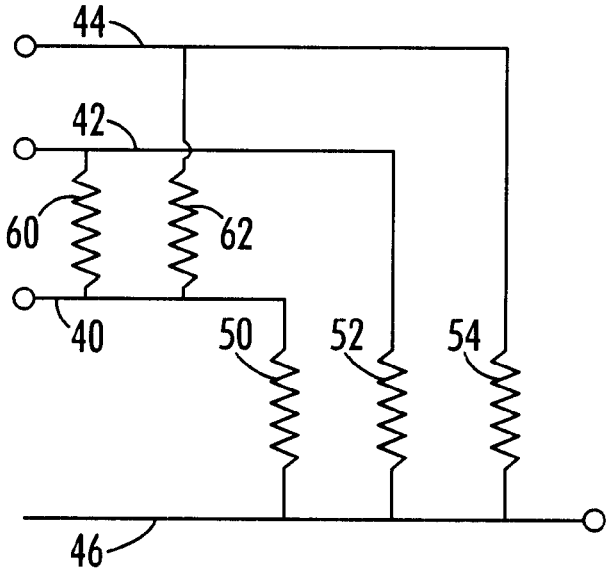
FIG. 3 is a schematic view of a lamp with more than two filaments, according to a preferred embodiment of the present invention.

FIG. 3 illustrates schematically a three filament bulb. There is a primary electrode 40, a secondary electrode 42, a tertiary electrode 44 and a common electrode 46. Primary, secondary and tertiary electrodes 40, 42, and 44 are each electrically connected to common electrode 46 by a filament. Primary filament 50 electrically connects primary electrode 40 and common electrode 46; secondary filament 52 electrically connects secondary electrode 42 and common electrode 46; and tertiary filament 54 electrically connects tertiary electrode 44 to common electrode 46. A first shunt 60 will electrically connect primary electrode 40 and secondary electrode 42 when primary filament 50 fails; a second shunt 62 will electrically connect primary electrode 40 to tertiary electrode 44 when secondary filament 52 fails. Additional electrodes can be added in the same fashion.

Primary and secondary shunts 60, 62, must have different "off" resistances so that the open circuit voltage bridges the oxide coating of one before the other. Thus, as soon as primary filament 50 fails, an arbitration takes place among the shunts, with the first one to conduct welding to the electrodes.

Figure 4:
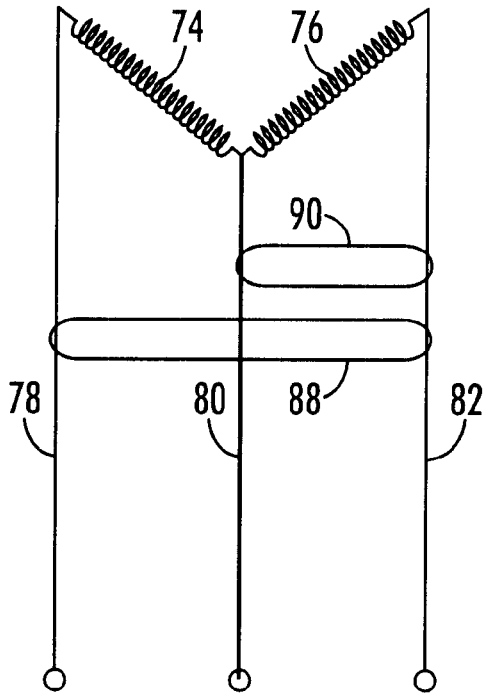
FIG. 4 is a cross sectional view of a lamp with a bypass shunt, according to an alternative preferred embodiment of the present invention.
Figure 5:
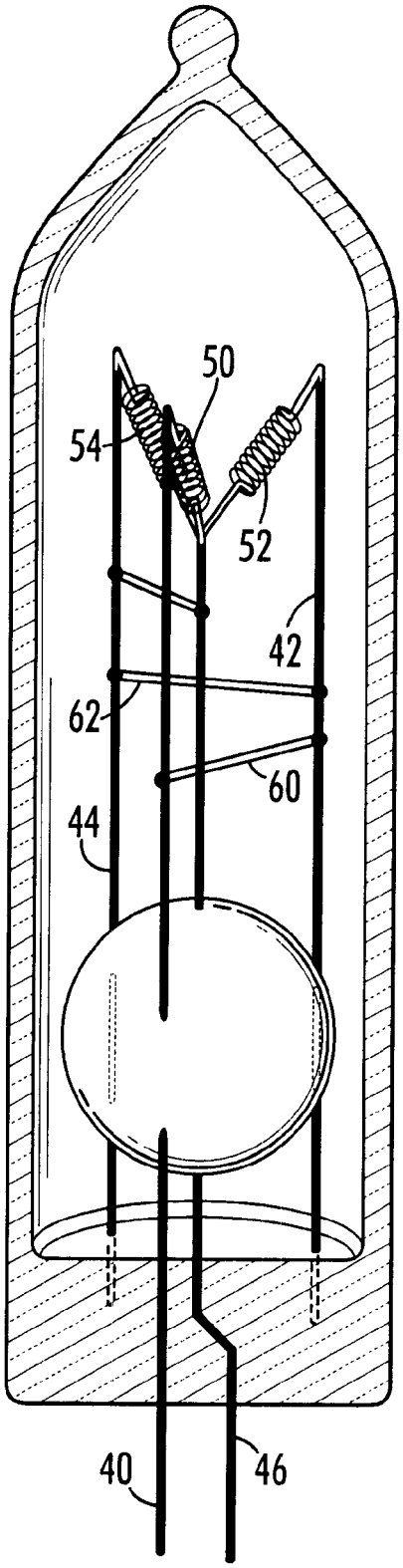
FIG. 5 is a cross-sectional view of a lamp, according to another preferred embodiment of the present invention.

An alternative embodiment, preferred for plural lamps connected electrically in series, includes a second, bypass shunt to keep the lamp operating when all filaments burn out. Referring to FIG. 4, there is shown a lamp similar to that of FIG. 1. It has a primary filament 74, a secondary filament 76, a primary electrode 78, a common electrode 80, a secondary electrode 82, and a wire 88 acting as a shunt, as before. However, in addition to wire 88, there is a bypass shunt 90 comprising a wire wrapped around common electrode 80 and secondary electrode 82. In the event both primary and secondary filaments 74, 76, fail, the open circuit voltage bridges the oxide coating on bypass shunt 90 and welds it to these electrodes in the same manner as wire 88 became welded to primary electrode 78 and secondary electrode 82. The bypass shunt 90 will have fewer turns, preferably 1.5 turns compared to 2.5 for wire 88, to assure that it has a higher resistance and lower incidence of contact until the secondary filament 76 burns out. Preferably bypass shunt 90 is made of a more resistive oxidized wire to assure that it stays out of the circuit unit all filaments are burned out.

Other modifications and substitutions will be apparent to those skilled in the art of lamp manufacture from the foregoing description of preferred embodiments without departing from the spirit in scope of the present invention, defined by the appended claims.

What is claimed is:

1. A lamp, comprising:

an envelope having an interior;

a primary filament having a first end and an opposing second end;

a secondary filament having a first end and an opposing second end;

a primary electrode extending through said envelope;

a common electrode extending through said envelope;

a secondary electrode anchored in said envelope, said primary, common and secondary electrodes being spaced apart, said first end of said primary filament being connected to said primary electrode, said second end of said primary filament being connected to said common electrode, said first end of said secondary filament being connected to said common electrode, and said second end of said secondary filament being connected to said secondary electrode;

a tertiary electrode;

a tertiary filament;

a tertiary electrode shunt, said tertiary electrode shunt in series electrical connection with said tertiary filament and in parallel electrical connection with said primary filament and said secondary filament; and switch means in electrical connection with said primary electrode and said secondary filament for directing current through said secondary filament when said primary filament fails and causing said secondary filament to provide illumination outside of said envelope.

2. The lamp of claim 1, wherein said switch means further comprises a shunt, said shunt bypassing said primary filament when said primary filament fails.

3. The lamp of claim 1, wherein said switch means further comprises an oxide metal wire wrapped around said primary electrode and said secondary electrode.

4. The lamp of claim 1, further comprising a bypass shunt being in electrical connection between secondary electrode and common electrode, said bypass shunt electrically connecting said secondary electrode and said common electrode when said primary and said secondary filament fail.

5. The lamp of claim 1, wherein said switch means conducts current from said primary electrode to said common electrode through said secondary filament when said primary filament fails.

6. The lamp of claim 1, further comprising a bypass shunt in electrical connection between said secondary electrode and said common electrode, said bypass shunt electrically connecting said primary electrode to said common electrode when said primary filament and said secondary filament fail.

7. The lamp of claim 1, wherein said secondary electrode is anchored in the wall of said envelope.

8. The lamp of claim 1, further comprising an insulator, said insulator providing inter-electrode spacing between each of said primary electrode, said common electrode, and said secondary electrode, wherein said primary electrode, said common electrode, and said secondary electrode pass through said insulator in spaced apart relation.

9. A lamp, comprising:

an envelope having an interior;

a primary filament having a first end and an opposing second end;

a secondary filament having a first end and an opposing second end;

a tertiary filament having a first end and an opposing second end;

a primary electrode extending through said envelope;

a common electrode extending through said envelope;

a secondary electrode anchored in the wall of said envelope;

a tertiary electrode anchored in the wall of said envelope, said primary, common, secondary and tertiary electrodes being spaced apart, said first end of said primary filament being connected to said primary electrode, said second end of said primary filament being connected to said common electrode, said first end of said secondary filament being connected to said common electrode, said second end of said secondary filament being connected to said secondary electrode, said first end of said tertiary filament being connected to said common electrode, and said second end of said tertiary filament being connected to said tertiary electrode;

a first switch means in electrical connection with said primary electrode and said secondary filament for directing current through said secondary filament when said primary filament fails and causing said secondary filament to provide illumination outside of said envelope; and a second switch means in electrical connection with said primary electrode and said tertiary filament for directing current through said tertiary filament when said primary and said secondary filaments fail and causing said tertiary filament to provide illumination outside of said envelope.

10. The lamp as recited in claim 9, wherein said switch means further comprises a bypass shunt, said bypass shunt electrically connected in parallel with said primary filament, said bypass shunt conducting current from said primary electrode to said common electrode upon failure of said primary filament, said secondary filament, and said tertiary filament.

* * * * *